United States Patent [19]

Lieberman

[11] 4,026,620

[45] May 31, 1977

[54] CONTROL FUNCTION SELECTION CONNECTOR

[75] Inventor: Morris S. Lieberman, Silver Spring, Md.

[73] Assignee: The United States of America as represented by the Secretary of the Navy, Washington, D.C.

[22] Filed: Jan. 28, 1976

[21] Appl. No.: 653,047

[52] U.S. Cl. ..... 339/19; 200/51.11

[51] Int. Cl.² ..... H01R 31/08

[58] Field of Search ..... 339/32 R, 32 M, 19; 200/51.1, 51.11; 307/10 AT

[56] References Cited

UNITED STATES PATENTS

| | | | |
|---|---|---|---|
| 3,004,170 | 10/1961 | Greenspan | 307/10 AT |
| 3,231,767 | 1/1966 | Powell | 339/32 M |

FOREIGN PATENTS OR APPLICATIONS

| | | | |
|---|---|---|---|
| 1,348,587 | 12/1963 | France | 339/19 |

*Primary Examiner*—David Smith, Jr.

*Attorney, Agent, or Firm*—R. S. Sciascia; A. L. Branning; W. C. Anderson

[57] ABSTRACT

A multiple-contact connector assembly couples with a multiple-contact terminal socket of a control mechanism to permit rapid and reversible external selection and alteration of internal electrical functions and settings within the mechanism. Shunt plugs are employed to externally complete or to break electrical circuits having terminals in the multiple-contact socket to establish the desired functions and settings, the plugs being enclosed within a cover which presses against the ends of the plugs via a resilient pad to ensure good electrical connections.

1 Claim, 3 Drawing Figures

CONTROL FUNCTION SELECTION CONNECTOR

BACKGROUND OF THE INVENTION

This invention relates generally to electrical connectors. More particularly, the present invention relates to an electrical connector which permits rapid and reversible external selection and alteration of internal electrical settings.

The performance and effectiveness of many ordnances are enhanced by the provision of selective, alternative operational modes. A mine, for example, has a selectively adjustable time to arm, i.e., the time lapse between deployment and fuse arming; a selectively variable "sterilization" time, or the time that the mine remains armed; and various target detection modes, such as acoustic, pressure and/or electromagnetic. Within each of the target detection modes, there are selective sensitivity limits. These alternative operational modes are commonly called "functions". Thus, one "function" of a target detection device in a mine may be a target area scan every 32 seconds; another "function" may be a target area scan every 32 minutes; and so forth, for various clock run-out, or "dead", periods..

The ordnance's alternative operational modes, or "functions", are electrically wired into the control device, such as a target detector device in the example mine considered above, and the desired functions are selected by completing or breaking the proper circuits. A method traditionally used to select functions was to bring out the wire loops from the control device and cut the loops which were not needed. This method was obviously not reversible, left wire pieces exposed, and mistakes could not readily be corrected. Furthermore, because of space limitations adjacent the control mechanism, only a small number of wires were accessible to be cut.

With the present invention, a means is provided for changing or selecting certain electrical functions within a sealed or enclosed package or unit, such as a control mechanism, and to permit the function selection or change from outside the package or unit. The device disclosed herein permits the external selection of a number of different internal settings within the controlled device, these settings being susceptible of change and/or reversal at any time up to loading or deployment of the controlled device. In the event that the controlled device is not deployed and is returned, then the controlled settings can be quickly reestablished at a future date.

SUMMARY OF THE INVENTION

Accordingly, it is an object of the present invention to provide a means for selecting or changing certain electrical settings within a controlled unit.

Another object of the invention is to provide a means for rapidly selecting or changing certain electrical settings within a controlled unit from outside the unit.

Another object of the invention is to provide a means for reversibly selecting or changing certain electrical setting within a controlled unit from outside the unit.

Yet another object of the invention is to provide a means for the external selection or change of certain electrical settings within a controlled unit which takes the form of an electrical connector assembly.

Still another object of the invention is to provide a connector assembly for the external selection or change of certain electrical settings within a controlled unit that is readily secured to the controlled unit.

Briefly, these and other objects of the invention are attained in an electrical connector assembly that is readily attached to the multiple-contact terminal of a plurality of electrical circuits in a control device. Shunt plugs are inserted into or removed from the terminal to externally complete or to break electrical circuits to establish the desired functions and settings within the control device. A cover protects the shunt plugs, and a resilient pad inside the cover presses against the ends of the plugs to ensure a snug fit.

BRIEF DESCRIPTION OF THE DRAWINGS

A more complete understanding of the invention and a fuller appreciation of the many attendant advantages thereof will be derived by reference to the following detailed description when considered in connection with the accompanying drawings wherein.

DESCRIPTION OF THE PREFERRED EMBODIMENT

Figure 1:
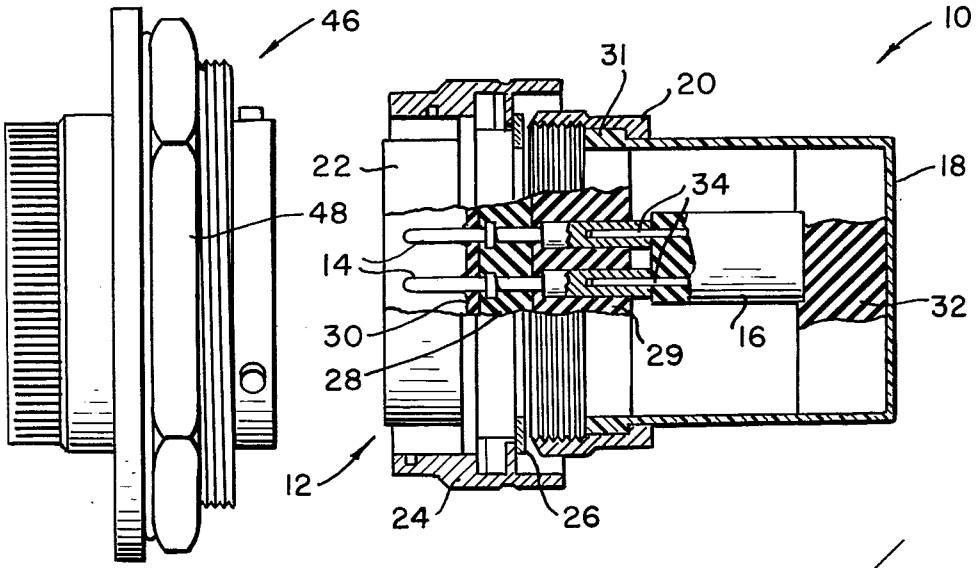
FIG. 1 is a cross-sectional view of the invention.

Referring now to the drawings wherein like reference characters designate identical or corresponding parts throughout the several views, and more particularly to FIG. 1 thereof, the control function selection connector assembly of the present invention is shown generally at 10 and includes a multiple-contact electrical connector 12, a plurality of contact pins 14, a plurality of removable shunt plugs 16, and a cover 18 attached to the connector 12 by a ring 20. To enhance the clarity of FIG. 1, only one pair of contact pins 14 and one shunt plug 16 have been shown. Any number of these pins may be used. The multiple-contact connector 12 is an item familiar to those skilled in the art. It may be a bayonet-type, quick-disconnect connector commonly used to couple a plurality of electrical conductors by attachment to a mating multiple-contact connector socket 46, and includes a center portion 22 rotatably coupled to the locking collar 24 by a split-ring spring 26. The center portion 22 of the connector 12 is provided with a contact pin-receiving disk having a central layer 28 of a suitable dielectric material, such as plastic, and surface layers 29 and 30 of a resilient, sealing material, such as silicon rubber, on either side of the central layer. Layers 28, 29 and 30 have a plurality of alinged holes therein to receive the contact pins 14, the holes generally being spaced circularly.

Contact pins 14, shown in FIG. 1 to be of the common "male" type, are provided at one end with "female" contacts to receive the shunt plug 16, with the male portion being suitably received by the appropriate female contacts in the socket 46. Cover 18, attached to the connector 12 with the internally-threaded ring 20 bearing against a circumferential, external lip 31 on the cover, is provided with a resilient pad 32 which presses against the end of the shunt plug 16 to hold the plug snugly in place.

Figure 2:
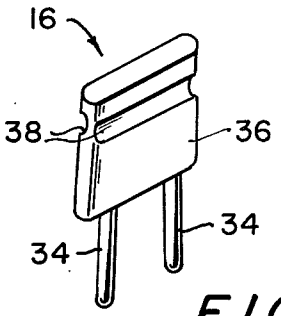
FIG. 2 is an enlarged, perspective view of one of the shunt plug used with the invention.

Shown to an enlarged scale in FIG. 2 is one of the shunt plugs 16. A conductor wire 34 is suitably bent into a U-shape, with a curved end embedded in an insulator jacket 36 of a suitable dielectric material, such as plastic, which may be color coded for quick identification. To facilitate removal of the shunt plug 16 from the connector 12, a pair of grooves 38 are provided on the lateral surfaces of the insulator jacket 36.

Figure 3:
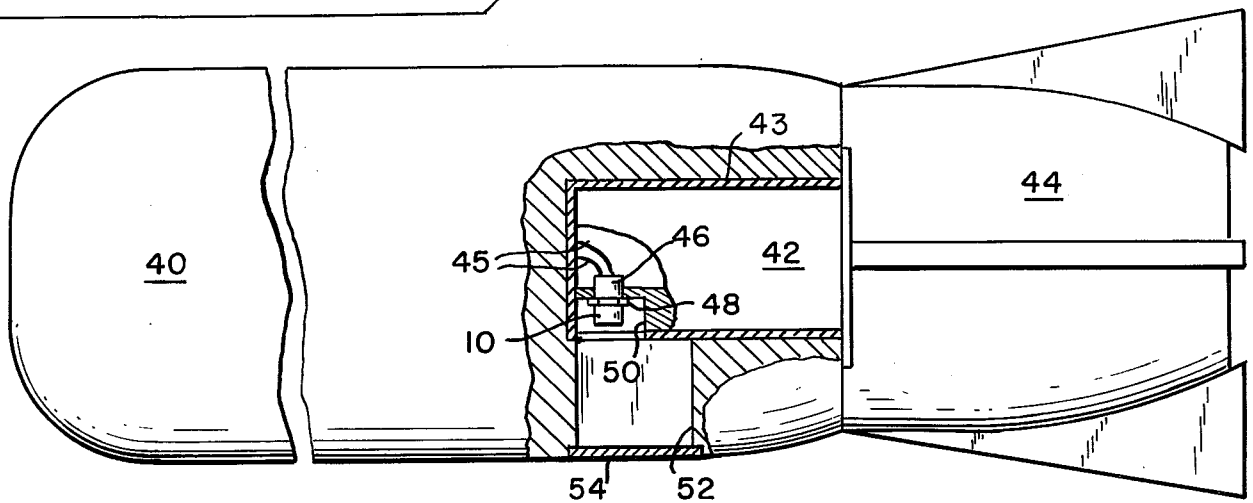
FIG. 3 illustrates an example installation of the invention.

An example installation of the function selector connector assembly 10 of the present invention is shown in FIG. 3, wherein a mine 40 is shown schematically and embodies the connector assembly coupled to the target detector 42. The target detector is positioned inside a sleeve 43 received within a well provided adjacent the aft portion of the mine 40.

Tail assembly 44 is attached to the mine adjacent the target detector 42, the assembly capable of being sheared off upon water entry to expose the detector when the mine is in the final, vertical position. The functioning of the mine 40, the shearing separation of the tail assembly, and the functioning of the target detector are familiar to those skilled in the art, and require no further discussion hereinafter.

The target detector 42 and the mine's fuse (not shown) are appropriately wired for the necessary control functions, with the wires 45 for these circuits terminating in a multiple-contact plug 46, such as a multiple-contact, female connector socket known in the art and shown in FIG. 1. Socket 46 is suitably attached to the target detector 42, as with a positioning lock ring 48, so as to permit access to the female contact pins from outside the detector via a covered recess 50 on the side of the detector. The function selection connector assembly 10 is received by the socket 46 to couple the connector assembly to the mine's control circuitry. To permit access to the socket 46 and the recess 50, an access well 52, commonly known as a "hand hole", extends laterally inwardly from the surface of the mine 40. A fluid-tight cover 54 seals the access well 52 after installation of the connector assembly 10.

As indicated above, the control functions of the mine are wired into the fuse and the target detector 42, with nominal values for each function mode being preset if the circuits are unaltered. The contact terminals in the socket 46 provide external access to the electrical circuits of these control functions, each pair of terminals representing alternative circuits within each control function circuitry. For example, the control circuitry for the time-to-arm function of the mine fuse may be preset for a minimum time, e.g., 7 minutes, if all of the control circuits for this function are complete and intact. Thus, if all of the circuits for this function have been completed, as by insertion of shunt plugs 16 described hereinabove, then the fuse will arm seven minutes after the mine has been deployed. Other circuits in the fuse's time-to-arm function would control similar time lapses in the timing mechanism regulating this function. Thus, there may be additional time lapse increments, for example, of 14, 28, 64 minutes, etc. depending upon which circuits have been completed or shorted. Therefore, if the fuse's time-to-arm circuitry is fully completed with external shunt plugs 16, then the fuse will be armed seven minutes after mine deployment. If, however, the conditions or requirements of a particular mission necessitate a longer delay time, then the appropriate circuit terminals in the socket 46 can be shorted by removal of the proper shunt plug 16 from the proper contact terminals in the connector 12. By thus shorting out the proper terminals, the fuse timing mechanism may, for example, operate for 28 minutes prior to arming the fuse. This function selection or alteration process would be completed before the mine is loaded aboard the deployment vehicle, and is achieved by removing the fluid tight cover on the recess 50, and removing the connector assembly 10 from the socket 46 by rotating the quick disconnect coupling collar 24, such couplings being well-known in the art. The cover 18 is then detached by release of the ring 20, and the proper shunt plug 16 is removed from the appropriate terminals. The foregoing process is reversed to reassemble and to place the connector assembly 10 back into the mine's control circuitry. Of course, other functions in the mine's control mechanism would be similarly selected or changed, or changed again.

It should be noted that a predetermined nominal value for each control function can be established by a complete, intact control circuit, with the terminals in the socket 46 being alternative branch circuits. Then, if the terminals are unaltered. i.e., if the alternative branch circuits are not completed with shunt plugs 16, the pre-wired nominal value of control setting will regulate the control function. This control setting can then be altered by selecting from a set of pre-established values by completing one or more of the branch circuits represented by the appropriate pairs of terminals in the socket 46 by insertion of the necessary shunt plugs 16 into the corresponding pins 14 in the connector 12. Conversely, the predetermined nominal value for each control function can be established by use of the shunt plugs to complete all of the alternative branch circuits within each control circuit, this being the method described hereinabove. As indicated above, alternative control settings would then be established by selective removal of one or more of the shunt plugs 16 to short out the alternative circuits associated with the terminals in socket 46 and the corresponding pair of pins 14 in the connector 12.

To expedite the proper selection of functions, the insulator jackets 36 on the shunt plugs 16 to color coded. Thus, for example, shunt plugs with red insulator jackets may be used for the fuse's time-to-arm function, while a yellow jacket may be used for the fuse's sterilization time function. Of course, charts, diagrams, tables, etc., may be used to assist in the proper function selection, and test devices may be coupled to the connector assembly 10 to further ensure proper function selection and proper operation of the connector.

While the connector assembly of the present invention has been described in the environment of a mine, this illustration should be construed as an example only and not as a limitation on the utility of the device. The connector may be used whenever the capability is desired for the rapid and reversible external selection or alternation of an internal electrical circuit or setting. Obviously, numerous modifications and variations of the present invention are possible in the light of the above teachings. It is therefore to be understood that within the scope of the appended claims the invention may be practiced otherwise than as specifically described herein.

What is claimed as new and desired to be secured by Letters Patent of the United States is:

1. In combination with a control mechanism having a plurality of circuits provided with branch termini, a connector assembly attachable to the termini to permit the external selection and alteration of the circuits within the control mechanism comprising:

a connector housing for attachment to the control mechanism;

a plurality of insulated pins within said connector housing for engaging connection with the termini of the circuits;

a plurality of removable shunt plugs connectable with said insulated pins, each of said shunt plugs comprises a single continuous conductor element having a U-shape, the curved portion of which is covered by an insulating material, a pair of grooves, provided in the covering insulating material of each shunt plug to facilitate removal of said shunt plugs;

a cover attachable to said connector for enclosing said connector for enclosing said shunt plugs;

a resilient pad within said cover, said pad abutting each of said shunt plugs when said cover is attached to said connector and a collar cooperating with said cover and said connector to attach said cover to said connector.

whereby connection of each of said removable shunt plugs with selected pairs of said termini completes the circuit associated with said selected pairs of termini and removal of each said shunt plugs opens the circuit associated with said selected pairs of termini.

* * * * *